US006526712B2

(12) United States Patent
Brooks et al.

(10) Patent No.: US 6,526,712 B2
(45) Date of Patent: Mar. 4, 2003

(54) EXTRUDED COMPOSITE INTERLOCKING CORNER ASSEMBLY

(75) Inventors: Joseph G. Brooks, Junction, TX (US); Michael M. Tull, Roswell, GA (US); James E. Roach, Mableton, GA (US)

(73) Assignee: Advanced Environmental Recycling Technologies, Inc., Springdale, AR (US)

( * ) Notice: Subject to any disclaimer, the term of this patent is extended or adjusted under 35 U.S.C. 154(b) by 0 days.

(21) Appl. No.: 10/052,850

(22) Filed: Nov. 2, 2001

(65) Prior Publication Data

US 2002/0170252 A1 Nov. 21, 2002

Related U.S. Application Data

(60) Provisional application No. 60/292,373, filed on May 21, 2001.

(51) Int. Cl.[7] ..... E04B 2/00; E04B 2/08; E04B 1/00

(52) U.S. Cl. ..... 52/287.1; 52/288.1; 52/592.1; 52/591.4; 52/272; 52/281

(58) Field of Search ..... 52/287.1, 288.1, 52/255, 256, 257, 592.1, 591.4, 272, 281, 282.1

(56) References Cited

U.S. PATENT DOCUMENTS

| | | | | |
|---|---|---|---|---|
| 1,875,576 | A | * | 9/1932 | Een |
| 2,373,789 | A | * | 4/1945 | Smith |
| 4,411,120 | A | * | 10/1983 | Ellis |
| 4,827,683 | A | * | 5/1989 | Poole |
| 6,258,190 | B1 | * | 7/2001 | Sciarrino |
| 6,344,268 | B1 | * | 2/2002 | Stucky |

* cited by examiner

*Primary Examiner*—Carl D. Friedman
*Assistant Examiner*—Kevin McDermott
(74) *Attorney, Agent, or Firm*—Locke Liddell & Sapp LLP; Monty L. Ross

(57) ABSTRACT

A corner assembly for covering a junction between adjacent walls includes first and second members, each formed from an extruded composite material comprising wood fiber and polyethylene resin. The first member includes a tongue extending from one end thereof. The second member includes a groove formed in one side thereof, such that when the tongue is received within the groove, the first side of the first member and the first end of the second member are disposed generally coplanar.

11 Claims, 2 Drawing Sheets

EXTRUDED COMPOSITE INTERLOCKING CORNER ASSEMBLY

RELATED APPLICATION

This application claims priority to U.S. patent application Ser. No. 60/292,373 filed May 21, 2001, and entitled "Extruded Composite Interlocking Corner Assembly".

TECHNICAL FIELD OF THE INVENTION

The present invention relates to extruded composite building materials, and more particularly to an interlocking corner assembly for sealing corners and joints.

BACKGROUND OF THE INVENTION

Traditional building construction techniques for frame exterior walls typically utilize siding materials with ends that are substantially aligned at the building corners. Vertically oriented trim boards are often nailed or stapled in abutting contact over the siding ends at the corners to improve the appearance and to reduce the likelihood of wind and water leakage into the structure. Unfortunately, such trim boards are very susceptible to warping and splitting, which detracts from the appearance over time and also allows moisture to enter the junction between adjacent walls, contributing to leakage, rotting and damage to interior walls. The corner joints formed using conventional trim boards, which do not interlock, may also be uneven and otherwise unsatisfactory due to poor installation practices.

A need has thus arisen for a corner assembly that provides consistent quality, improved appearance and reliable protection against wind and water leakage while reducing the installation defects, maintenance costs and weather-related degradation associated with the use of conventional building materials and construction techniques.

SUMMARY OF THE INVENTION

In accordance with the present invention, a corner assembly for covering a junction between adjacent walls is provided. The corner assembly includes first and second members, and each member is formed from a composite material extruded from a mixture of wood fiber encapsulated in a thermoplastic polymeric matrix consisting primarily of polyethylene resin. The first member includes a tongue extending from one end thereof. The second member includes a groove formed in one side thereof, such that when the tongue is received within the groove, the first side of the first member and the first end of the second member are disposed generally coplanar.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
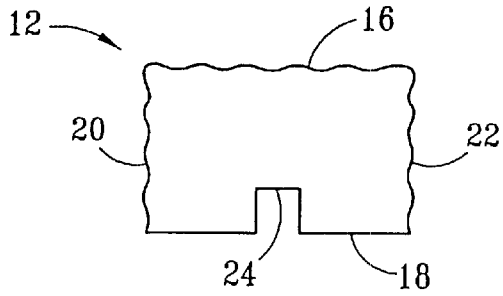
FIG. 1 is an end view of a groove board of the present invention.
Figure 2:
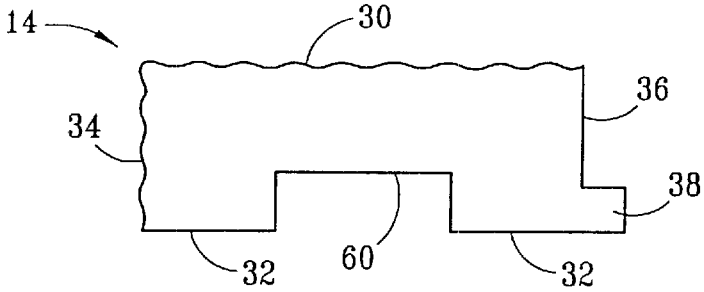
FIG. 2 is an end view of a tongue board of the present invention.
Figure 3:
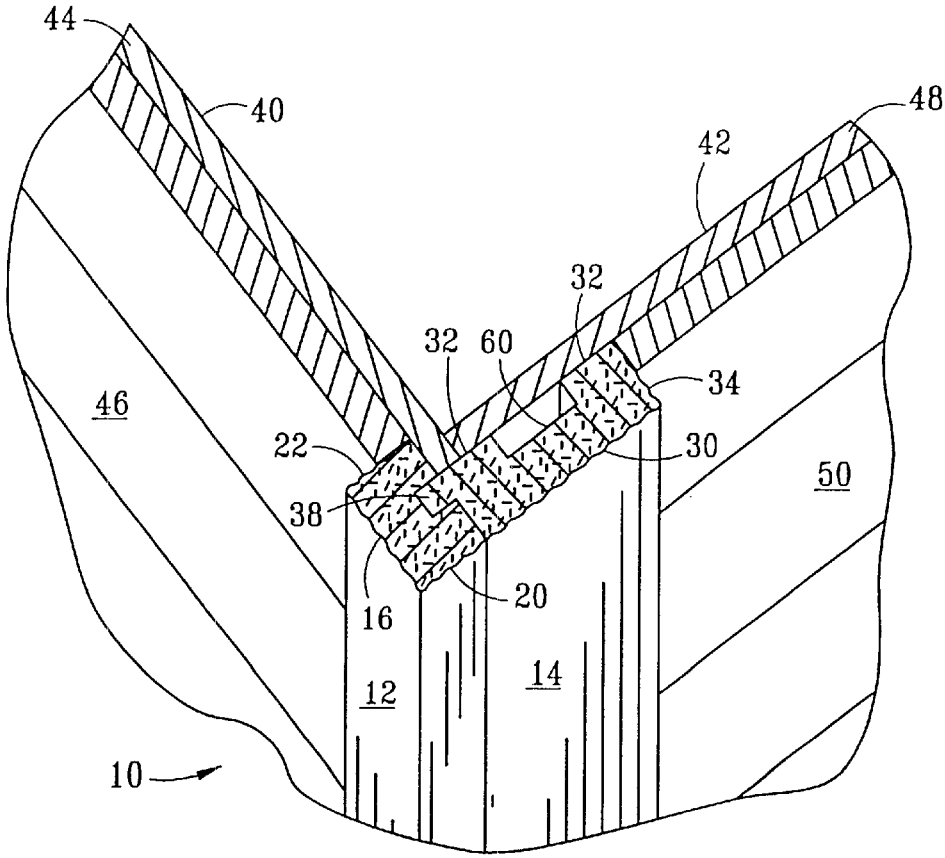
FIG. 3 is a perspective view of the interconnection of the present groove and tongue boards forming a corner assembly for two walls.

Referring simultaneously to FIGS. 1, 2, and 3, the present corner assembly, generally identified by the numeral 10 (FIG. 3) preferably includes a groove board, generally identified by the numeral 12, and a tongue board, generally identified by the numeral 14. Boards 12 and 14 may be fabricated of a composite material such as, for example, an extruded mixture comprising wood fiber encapsulated in a polymeric matrix preferably containing polyethylene resin as a primary component, such material being described in U.S. Pat. No. 5,759,680 whose description and drawings are incorporated herein by reference.

Groove board 12 (FIG. 1) includes first and second spaced apart parallel sides 16 and 18. Groove board 12 further includes first and second parallel ends 20 and 22 which are generally perpendicular to sides 16 and 18. Side 18 of groove board 12 includes a groove 24 which may be formed, for example, by machining using conventional equipment.

Tongue board 14 (FIG. 2) includes first and second spaced apart sides 30 and 32. Additionally, tongue board 14 includes first and second parallel ends 34 and 36 which are disposed generally perpendicular to sides 30 and 32. Extending from end 36 of tongue board 14 is a tongue 38. Tongue 38 is received within groove 24 of groove board 12 to form corner assembly 10. When assembled into corner assembly 10, end 20 of groove board 12 and side 30 of tongue board 14 are disposed generally coplanar, and board 12 is disposed generally perpendicular to board 14 to form a corner.

Referring to FIG. 3, corner assembly 10 forms a corner overlapping walls 40 and 42, which are disposed generally perpendicular to one another. Wall 40 includes a trim board 44 and siding 46. Wall 42 includes a trim board 48 and siding 50. Groove board 12 and tongue board 14 snap together to overlap and seal the corner and joints formed between trim boards 44 and 48 of walls 40 and 42.

Referring again to FIG. 2, tongue board 14 includes an area 60 of reduced thickness between sides 30 and 32. Area 60 is cut from tongue board 14 by, for example, grinding or machining, or may be extruded as a profile having that shape. Area 60 of reduced thickness reduces the weight of tongue board 14, which is advantageous for shipping and installation purposes.

Figure 4:
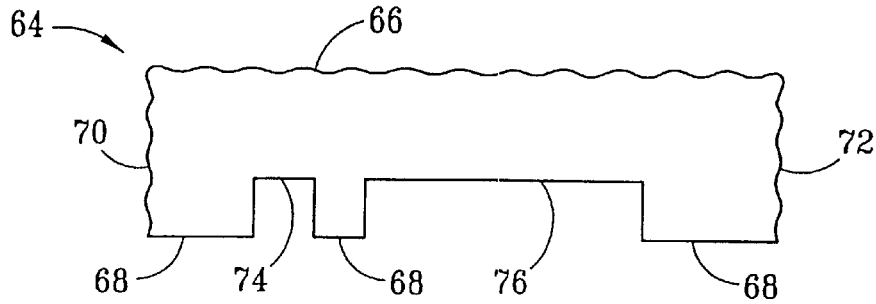
FIG. 4 is an end view of a groove board of an additional embodiment of the present invention.
Figure 5:
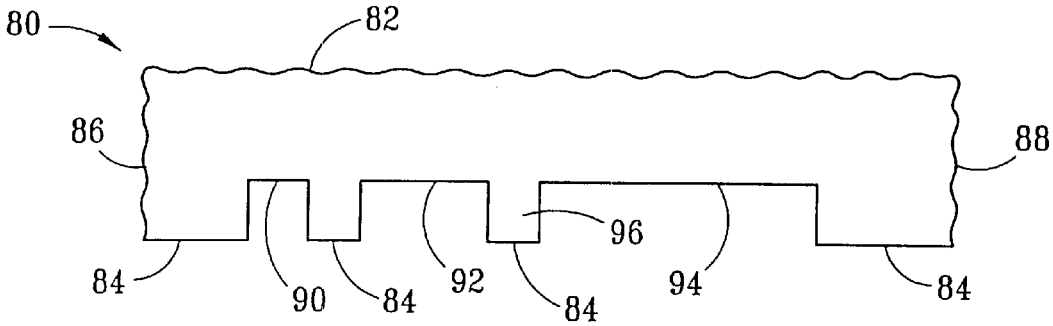
FIG. 5 is an end view of a groove board of a further embodiment of the present invention.

Referring now to FIGS. 4 and 5, additional embodiments of groove board 12 are illustrated. FIG. 4 illustrates a groove board, generally identified by the numeral 64 having sides 66 and 68, and ends 70 and 72. Groove board 14 includes a groove 74 in addition to an area of reduced thickness 76 between sides 66 and 68. Area 76 functions in a manner similar to area 60 (FIG. 2) of tongue board 14 to reduce the weight of groove board 64.

FIG. 5 illustrates a further embodiment of a groove board, generally identified by the numeral 80. Groove board 80 includes sides 82 and 84 and ends 86 and 88. Groove board 80 includes a groove 90 and spaced apart areas of reduced thickness 92 and 94. Areas 92 and 94 are spaced apart by a rib 96 which provides dimensional stability for groove board 80 where wider groove boards are necessary. Areas 92 and 94 function to reduce the weight of groove board 80.

Figure 6:
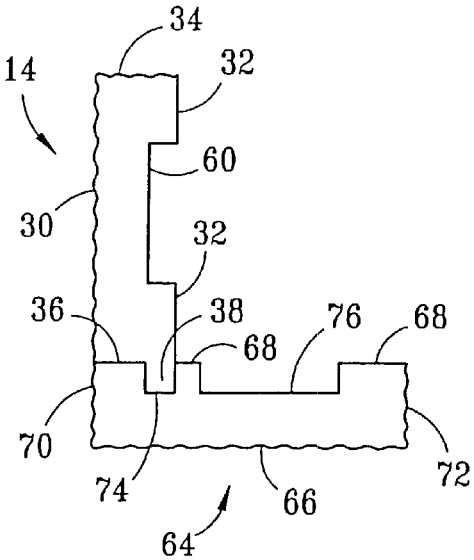
FIG. 6 is an end view of the interconnection of the present groove board shown in FIG. 4 and the present tongue board shown in FIG. 2.

FIG. 6 illustrates a corner assembly 10 formed from tongue board 14 (FIG. 2) and groove board 64 (FIG. 4). End 70 of groove board 64 and side 30 of tongue board 14 are disposed generally coplanar, and board 14 is disposed generally perpendicular to board 64 to form a corner.

Figure 7:
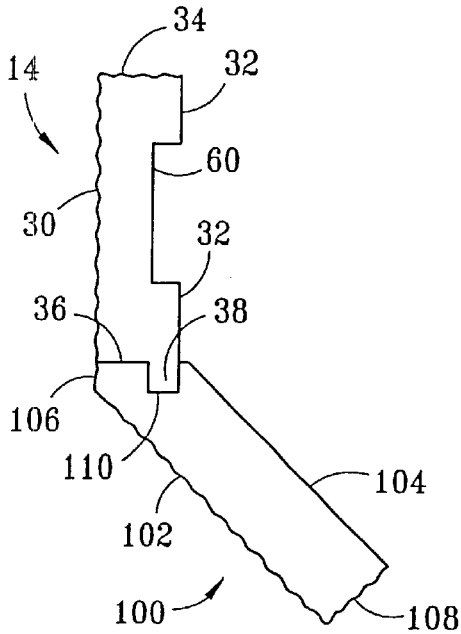
FIG. 7 is an end view of the interconnection of the present tongue board shown in FIG. 2 and a groove board of an additional embodiment of the present invention.

Referring to FIG. 7, an additional embodiment of a groove board is illustrated, and is generally identified by the numeral 100. Groove board 100 is utilized with a tongue board 14 to form a corner where adjacent walls are not generally perpendicular. Groove board 100 includes sides 102 and 104 and ends 106 and 108. Groove board 100 includes a groove 110 formed between end 106 and side 104.

Exterior surfaces of groove board 12 including side 16 and ends 20 and 22 and side 30 and end 34 of tongue board 14 may be textured to improve the aesthetic nature of groove board 12 and tongue board 14. Boards 12 and 14 can be attached to a building wall using commercially available fasteners such as, for example, nails, screws, or the like. If desired, suitable adhesives can also be employed to more tightly secure the tongue and groove joint between boards 12, 14, or in the attachment of boards 12, 14 to an underlying wall siding material, covering or other substrate.

It therefore can be seen that the present corner assembly provides for easy installation and eliminates uneven joints between building materials forming a corner of a structure. The present use of composite material extruded from wood fiber and polyethylene resin reduced installation problems and eliminates rot and other weather related failures of the building materials.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A corner assembly for covering a junction between adjacent first and second walls, the walls forming a corner, the assembly comprising:

first and second members formed of extruded composite material comprising wood fiber and polymeric resin;

each of said members having first and second spaced apart parallel sides and first and second ends, said members having a thickness between said first and second sides;

said first member first side including a recessed portion disposed between the first and second ends;

said first member first side adapted to overlap the junction between the adjacent walls, and said first member having a tongue extending from said first end thereof; and said second member first side having a groove for receiving said tongue, such that when said tongue is received within said groove, said second side of said first member and said first end of said second member are disposed generally coplanar and said first sides of said members form a corner disposed adjacent the first wall and offset from the junction between the adjacent walls.

2. The assembly of claim 1 wherein said tongue is disposed adjacent said second side of said first member.

3. The assembly of claim 1 wherein said second member includes a recessed portion spaced apart from said first side thereof.

4. The assembly of claim 1 wherein said second member includes first and second spaced apart recessed portions disposed between the first and second ends.

5. The assembly of claim 4 wherein said first and second recessed portions are separated by a rib.

6. The corner assembly of claim 1 wherein the wood fiber is substantially encapsulated in a continuous matrix of polymeric resin.

7. The corner assembly of claim 1 wherein the polymeric resin comprises polyethylene.

8. A corner assembly for covering a junction between adjacent first and second walls, the walls forming a corner, the assembly comprising:

first and second board members formed of extruded composite material comprising wood fiber and polyethylene resin;

each of said members having first and second spaced apart parallel sides and first and second ends, said members having a thickness between said first and second sides;

said first member first side including a recessed portion disposed between the first and second ends;

said first member first side adapted to overlap the junction between the adjacent walls, and said first member having a tongue extending from said first end thereof and disposed adjacent said second side thereof; and said first side of said second member having a groove for receiving said tongue, such that when said tongue is received within said groove, said second side of said first member and said first end of said second member are disposed generally coplanar and said first member is disposed generally parallel to one of the walls and said second member is disposed generally parallel to the other one of the walls and said first sides of said members form a corner disposed adjacent the first wall and offset from the junction between the adjacent walls.

9. The assembly of claim 8 wherein said second member includes a recessed portion spaced apart from said first side thereof.

10. The assembly of claim 8 wherein said second member includes first and second spaced apart recessed portions being spaced apart from said first side thereof.

11. The assembly of claim 10 wherein said first and second recessed portions are separated by a rib.

* * * * *